US005622108A

United States Patent [19]

Benedetto et al.

[11] Patent Number: 5,622,108

[45] Date of Patent: Apr. 22, 1997

[54] SCREEN PRINTING MACHINE

[75] Inventors: John R. Benedetto; William Gillespie, Jr., both of Everett; James W. Pomeroy, Seattle; Duke Goss; Charles J. Pomeroy, both of Kirkland, all of Wash.

[73] Assignee: Universal Screenprinting Systems, Inc., Everett, Wash.

[21] Appl. No.: 593,573

[22] Filed: Jan. 30, 1996

[51] Int. Cl.[6] ..... B41F 15/06

[52] U.S. Cl. ..... 101/126; 101/127.1; 101/128.4

[58] Field of Search ..... 101/DIG. 36, 114, 101/126, 127.1, 128, 128.1, 128.21, 128.4, 424.1

[56] References Cited

U.S. PATENT DOCUMENTS

| | | | |
|---|---|---|---|
| 3,964,385 | 6/1976 | Knight | 101/128.4 |
| 4,073,232 | 2/1978 | Brewer | 101/128.1 |
| 4,896,597 | 1/1990 | Hayata et al. | 101/128.21 |
| 4,981,076 | 1/1991 | Cunill | 101/127.1 |
| 5,048,417 | 9/1991 | Everroad | 101/123 |
| 5,355,791 | 10/1994 | Benedetto et al. | 101/126 |
| 5,544,581 | 8/1996 | Haji | 101/126 |

*Primary Examiner*—Ren Yan

*Attorney, Agent, or Firm*—Christensen, O'Connor, Johnson & Kindness PLLC

[57] ABSTRACT

A screen printing machine for: (i) creating an image bearing screen; (ii) using the image-bearing screen to create designs on a suitable substrate; and (iii) heating the print to cure the print ink. The bottom of a cabinet forms the base of a cavity that houses a series of ultraviolet (UV) lamps used to create an image-bearing screen. The top of the cavity is enclosed by a protective panel when the lamps are not being used. Narrow shelves that extend inwardly from the side walls support a pop-up screen holder that includes a U-shaped frame sized to receive a screen frame. A downwardly extending tube is slidably mounted in a vertical tubular hole. A coil spring creates an upward pressure on the U-shaped frame. The U-shaped frame is held down by a latch mechanism. A screen registration mechanism moves the U-shaped frame into a fixed position. A beveled block forces a print screen into a predetermined position. A platen support and registration mechanism including platen inclination and lateral adjustment mechanisms receives a downwardly extending leg located at the back of a garment support platen. Mounted beneath the platen support and registration mechanism, in alignment with the bottom of the platen leg, is a platen height adjustment mechanism. A heater having a tubular leg mounted in cylindrical hole in the housing is positionable above the platen. A slot located in the back wall of the housing allows elongate fabrics to be moved across the platen.

21 Claims, 7 Drawing Sheets

SCREEN PRINTING MACHINE

FIELD OF THE INVENTION

This invention relates to screen printing and, more particularly, to machines for screen printing designs on suitable substrates, such as textile fabrics.

BACKGROUND OF THE INVENTION

Screen printing is an old and established way of creating designs on various substrates, such as textile fabric, paper, metal, wood, glass, etc. Screen printing is essentially a stencil method of printing where the stencil is formed by a screen stretched over a wooden or metal frame. For finer detail, a finer mesh screen is used.

Early versions of screen printing used silk to form the screen. A design was created by painting the screen with a greasy medium. The pores of the silk were then closed using a suitable gum. The pores of the silk in the areas covered by the greasy medium were not closed because the greasy medium rejected the gum. Thereafter, the greasy medium was washed away with a solvent, such as turpentine, if paint was used as the greasy medium, resulting in the corresponding areas becoming pervious to ink. The screen was then placed on the surface of the substrate to be decorated and ink was applied through the screen to the surface using a rubber squeegee. The ink soaked through the pervious areas of the silk and was imprinted on the substrate.

More recent versions of screen printing use fine mesh screen materials rather than silk. The chosen screen material is coated with a photographic emulsion. The photographic emulsion is exposed to a suitable source of light with the image to be reproduced being located between the light and the emulsion. The light causes the emulsion to harden except in areas where the image is located. Thereafter, the screen is washed, which removes the emulsion from the areas where it has not been hardened by the light, i.e., the image areas. Then, the screen is used to print a design on a substrate.

In recent times, screen printing has been widely used to create a variety of single and multi-colored designs on a variety of textile fabric items, particularly clothing, such as T-shirts and sweatshirts. Various machines have been developed to improve screen printing. Unfortunately, the majority of such machines, particularly those designed to create multi-colored designs, are large and complex and, thus, expensive. Others are heavy, cumbersome, deteriorate rapidly, and lack adjustability.

In order to overcome the foregoing disadvantages, the All-in-one Screen Printing Machine described in U.S. Pat. No. 5,355,791 by John R. Benedetto and William Gillespie, Jr., was developed. The screen printing machine described in U.S. Pat. No. 5,355,791 is designed to be easily reconfigured to: (i) create an image-bearing screen; (ii) use the image-bearing screen to print designs on textile fabrics and other suitable substrates; and (iii) heat the design to set the print ink. The machine includes a metal cabinet with a horizontal shelf located beneath the top of the cabinet. Mounted on the metal shelf is a source of ultraviolet (UV) light. The upper ends of the metal cabinet walls are configured to receive a work surface suitable for supporting an image of the design to be printed and a framed screen. The image is preprinted on a sheet of material that passes UV light except where the image is located; and the screen is coated with a photographic emulsion. When exposed to the UV light, the photographic emulsion hardens, except where the image prevents the light from striking the emulsion. After exposure, the emulsion is washed to remove the remaining soft, unexposed (image) parts of the emulsion, creating a print screen. The all-in-one screen printing machine also includes an adjustable platen, preferably formed of metal, that is positioned just below the upper walls of the cabinet. The platen is suitable for supporting a piece of textile fabric, preferably in the form of a garment, such as a T-shirt, or other substrates suitable for receiving printing ink. The textile fabric or other substrate is mounted on the platen, which is positioned just below the print screen; and a squeegee is used to push the ink through the image apertures in the screen onto the fabric. A partially mechanical and partially manual registration mechanism allows print screens to be removed to inspect ink distribution and returned to their prior position if additional ink is required. The all-in-one screen printing machine also includes a heater positionable above a printed item to heat and cure the ink after it is applied.

While the all-in-one screen printing machine described in U.S. Pat. No. 5,355,791 is a substantial improvement over prior art screen printing machines, it is subject to improvement particularly in the areas of platen adjustability and the mechanism for supporting and registering a print screen. The present invention is directed to providing such an improved screen printing machine.

SUMMARY OF THE INVENTION

In accordance with this invention, a screen printing machine suitable for: (i) creating an image-bearing screen; (ii) using the image-bearing screen to print designs on textile fabrics and other suitable substrates; and (iii) heating the designs to set the print ink is provided. The machine includes the cabinet mounted atop a stand. Preferably the cabinet is detachable from the stand. The cabinet, which has an open top front and an open top, includes a bottom, a back wall, and a pair of side walls. Mounted on the bottom of the cabinet is an ultraviolet (UV) light source suitable for exposing a photographic emulsion to create an image-bearing screen. The machine includes a U-shaped frame sized to receive the frame of a print screen. The U-shaped frame is supported by shelves that extend inwardly from the side walls. Attached to one corner of the U-shaped frame is a downwardly extending leg. The machine also includes a screen registration mechanism that applies pressure to the U-shaped frame that causes the U-shaped frame to rotate about the downwardly extending leg into a screen registration position. Further, the machine includes a platen support and registration mechanism suitable for raising and lowering, and horizontally and laterally adjusting, the position of a platen located beneath the U-shaped frame. Finally, the machine includes a heater positionable above the U-shaped frame.

In accordance with other aspects of this invention, the leg of the U-shaped frame forms part of a pop-up mechanism that also includes a vertical hole located in one corner of the cabinet suitable for receiving the leg and a coil spring mounted in the leg and sized to create an upward pressure on the U-shaped frame. The pop-up mechanism also includes a latch mounted in the back wall of the cabinet that co-acts with a slot located in the U-shaped frame. The latch holds the U-shaped frame down, against the force created by the coil spring.

In accordance with further aspects of this invention, the screen registration mechanism comprises a screw adjustment assembly positioned in the back wall of the cabinet near the corner opposite the corner in which the pop-up mechanism's vertical hole is located.

In accordance with still other aspects of this invention, the outer end of one of the outwardly extending arms of the U-shaped frame includes a bevel block that is positioned so as to force a screen frame mounted in the U-shaped frame into a predetermined position against the opposite corner of the U-shaped frame, i.e., the corner between the other arm and the cross-member of the U-shaped frame.

In accordance with still further aspects of this invention, located at the back wall of the cabinet is a platen support and registration mechanism that receives a downwardly extending leg located at one end of a substrate (e.g., textile fabric) support platen. The platen support and registration mechanism includes platen height, inclination, and lateral adjustment and lock mechanisms.

In accordance with yet still other aspects of this invention, the back wall of the cabinet includes a horizontal slot through which substrates can be moved during printing to allow designs to be printed at several locations on elongated fabrics and other elongated substrates.

In accordance with yet still further aspects of this invention the housing includes a cavity located at the bottom in which the UV light source is located. Preferably, the top of the cavity is enclosed by a protective panel when the UV light source is not being used.

As will be readily appreciated from the foregoing description, the invention provides a new and improved screen printing machine that is easily reconfigured to create a print screen, use the print screen to print designs, and heat the designs to cure them. More specifically, in accordance with the invention, an image is created on a print screen by: (i) placing an image on a UV-passing work surface supported by the shelves that extend inwardly from the side walls; (ii) placing a print screen coated with a photographic emulsion in the U-shaped frame and lowering the U-shaped frame to a position above the image; and (iii) exposing the photographic emulsion to the UV light, causing the emulsion to harden except where the image prevents the light from striking the emulsion. In accordance with conventional processing, after exposure, the print screen is removed and washed to remove the soft unexposed (image) emulsion from the print screen to create an image bearing print screen. The image and the UV-passing work surface are also removed, unless additional print screens are to be created. Thereafter, the UV light source is covered and the platen is installed in the machine. The U-shaped frame is repositioned above the platen and the print screen is returned to the U-shaped frame. Then the print screen is used to create an image on a piece of textile fabric or other substrate supported by the platen. More specifically, the platen is adjusted so as to lie just beneath the print screen. Thereafter, a squeegee is used to push ink through the image apertures in the screen onto the fabric. Then, the print screen is removed and the ink is cured by moving the pre-energized heater into a position above the printed textile fabric.

The screen registration mechanism provides for more precise screen registration, i.e., registration better than that provided by the hold-down force created by the latch of the pop-up mechanism. The screen registration mechanism provides additional support for the U-shaped frame, holding the frame steady and allowing printing on the substrate, and removal and repositioning of the print screen in precisely the same location. That is, precise screen registration allows a print screen to be removed so that an image can be observed prior to heating and ink curing. If the image is incomplete, because an insufficient amount of ink was applied, the screen can be precisely returned to its prior position and additional ink applied before heating and ink curing. Precise screen registration also allows multi-colored images to be precisely created because screens placed seriatim in the U-shaped frame can be precisely positioned. After each ink is fully primed, the inks may be heated to a gel or partial curing temperature prior to another screen and additional ink being applied. After all of the inks are applied, the final product can be heated to the final ink curing temperature.

BRIEF DESCRIPTION OF THE DRAWINGS

The foregoing features and many of the attendant advantages of this invention will become more readily appreciated as the same becomes better understood by reference to the following detailed description of the presently preferred embodiment of the invention, when taken in conjunction with the accompanying drawings, wherein.

DETAILED DESCRIPTION OF THE PREFERRED EMBODIMENT

Figure 1:
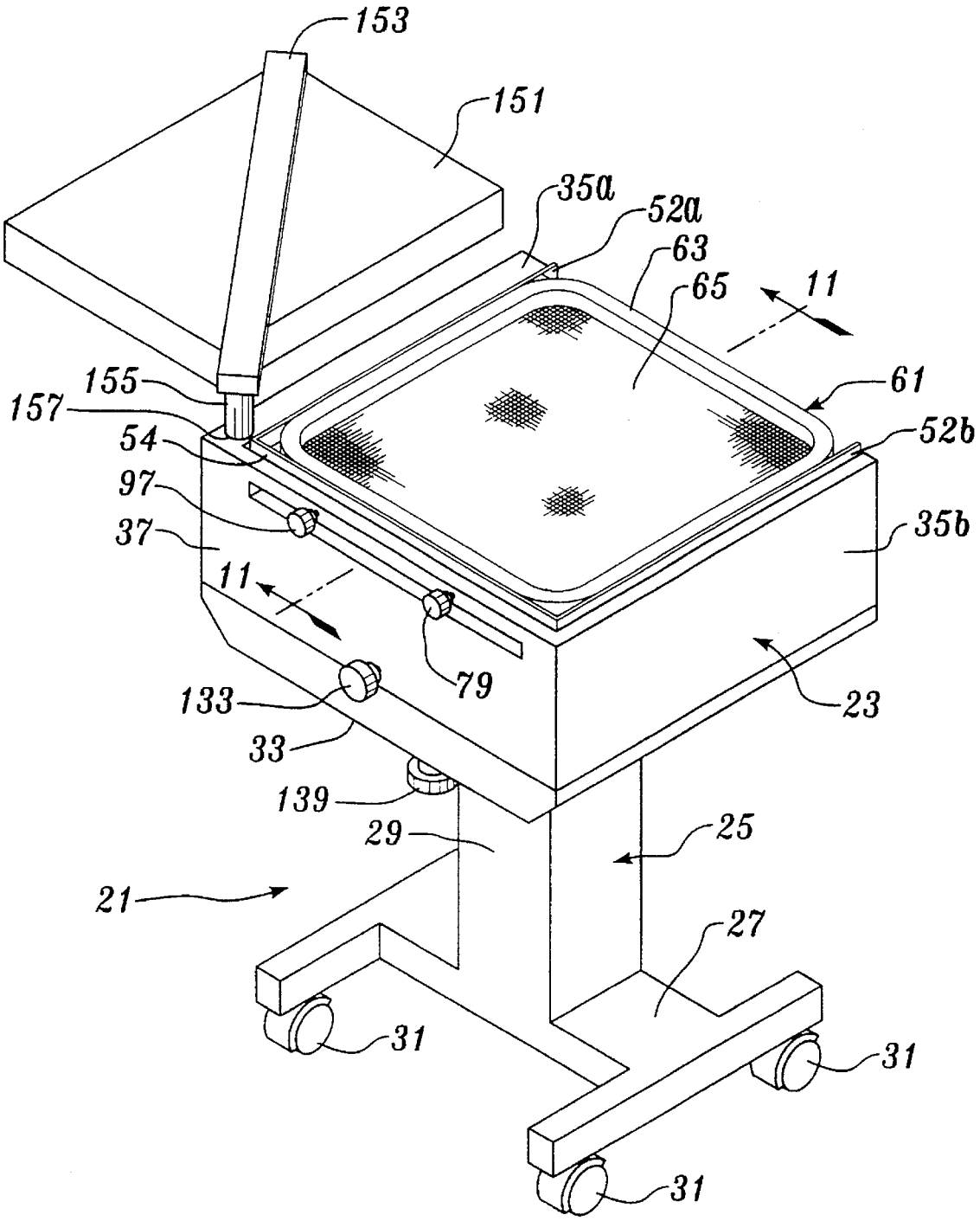
FIG. 1 is an isometric view of a preferred embodiment of the invention.

FIG. 1 illustrates a screen printing machine formed in accordance with the invention which comprises: a cabinet 23 mounted on a pedestal stand 25. The pedestal stand 25 has a horizontally oriented, H-shaped base 27 and a vertical pedestal 29 extending upwardly from the center of the H-shaped base 27. Roller wheels 31 are attached to the bottom of the H-shaped base, one near the outer end of each of the legs of the H-shaped base. The cabinet 23 is detachably mounted atop the pedestal 25.

The cabinet 23 houses the screen forming and printing components of the screen printing machine 11. More specifically, the cabinet 23 includes a bottom 33, a pair of side walls **35*a* and 35*b* and a back wall 37. The side walls 35*a* and 35*b* extend upwardly from opposite ends of the bottom 33 and the back wall 37 extends upwardly from the bottom 33, between the side walls. As a result, the cabinet 23** has an open front and an open top.

Figure 11A:
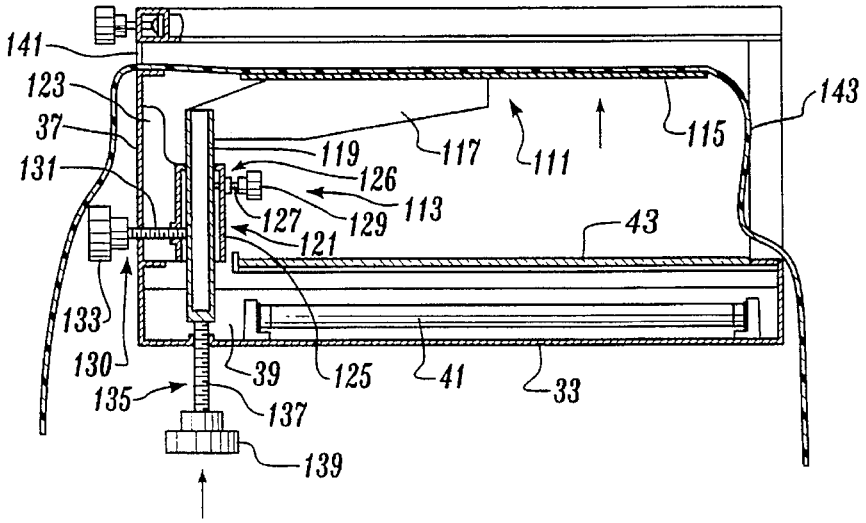
FIGS. 11A–11C are cross-sectional views taken along lines 11—11 of FIG. 1 showing the details of the platen and the platen support and registration mechanism of the invention.
Figure 11B:
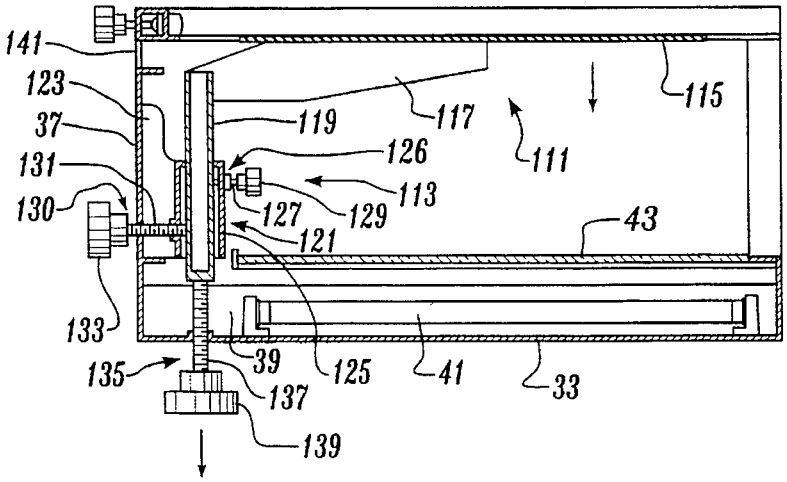
Figure 11C:
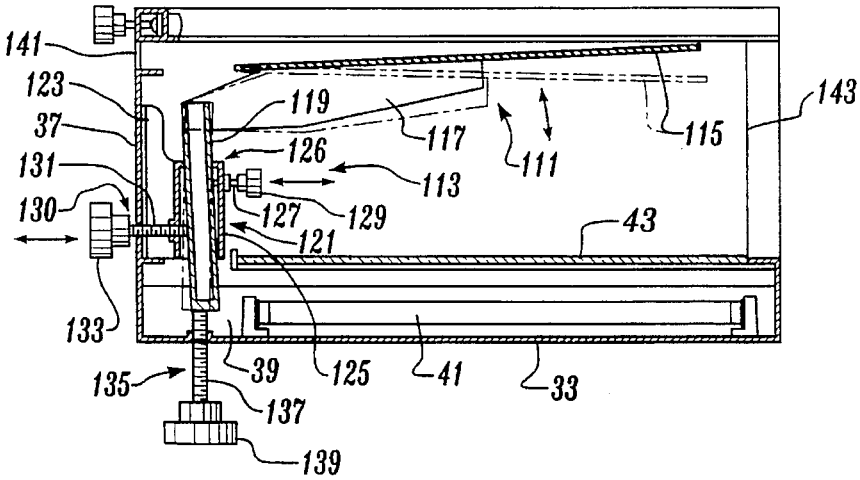

As shown in FIGS. 11A–11C, located inside of the cabinet 23, above the bottom 33, is a cavity 39. A plurality of ultraviolet (UV) lights 41 are mounted in the cavity 39. The top of the cavity 39 is enclosed by a cover plate 43 that is removed when the UV lights 41 are used in the manner described below to create a print screen image.

Figure 2:
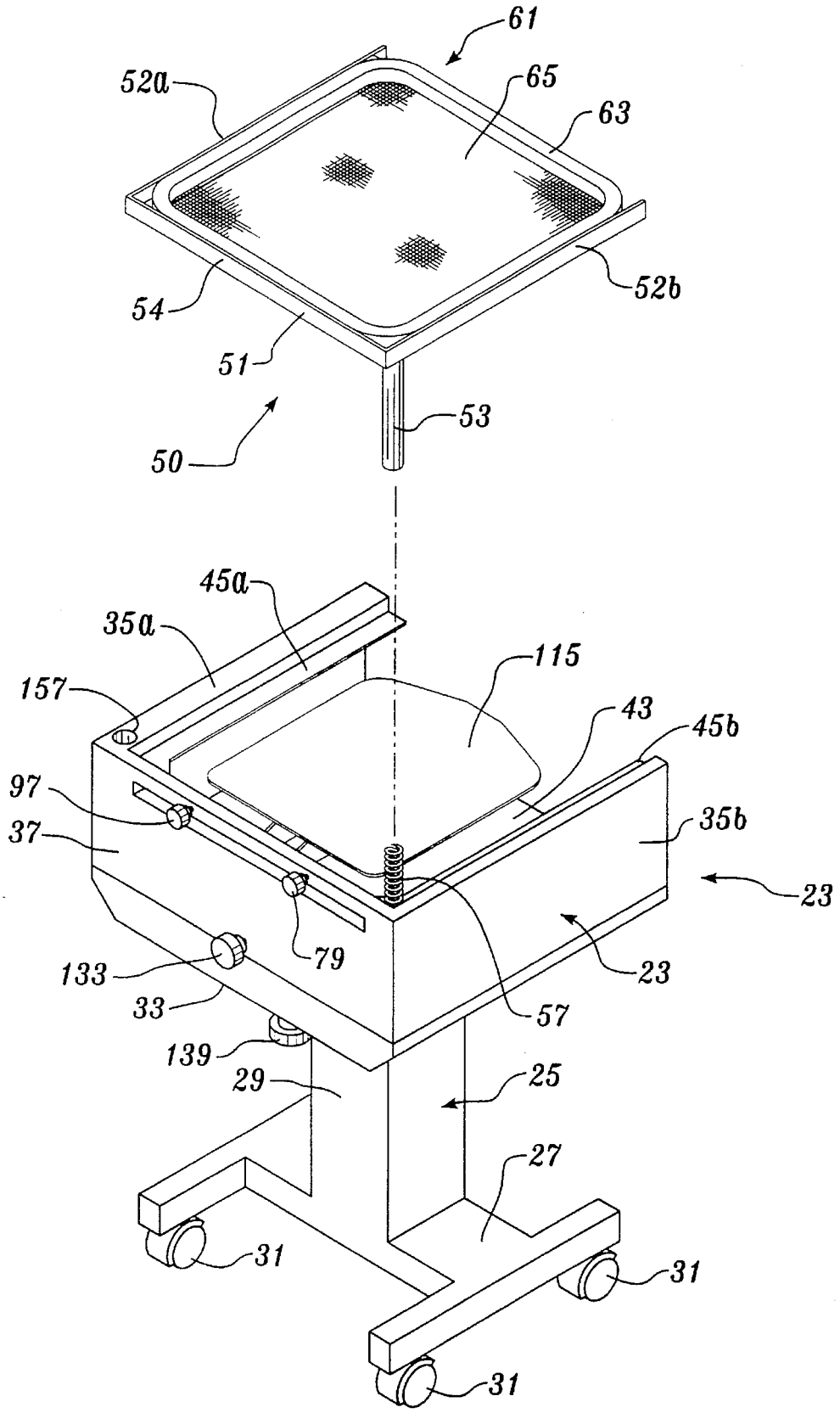
FIG. 2 is a partially exploded view of the embodiment of the invention illustrated in FIG. 1.
Figure 3:
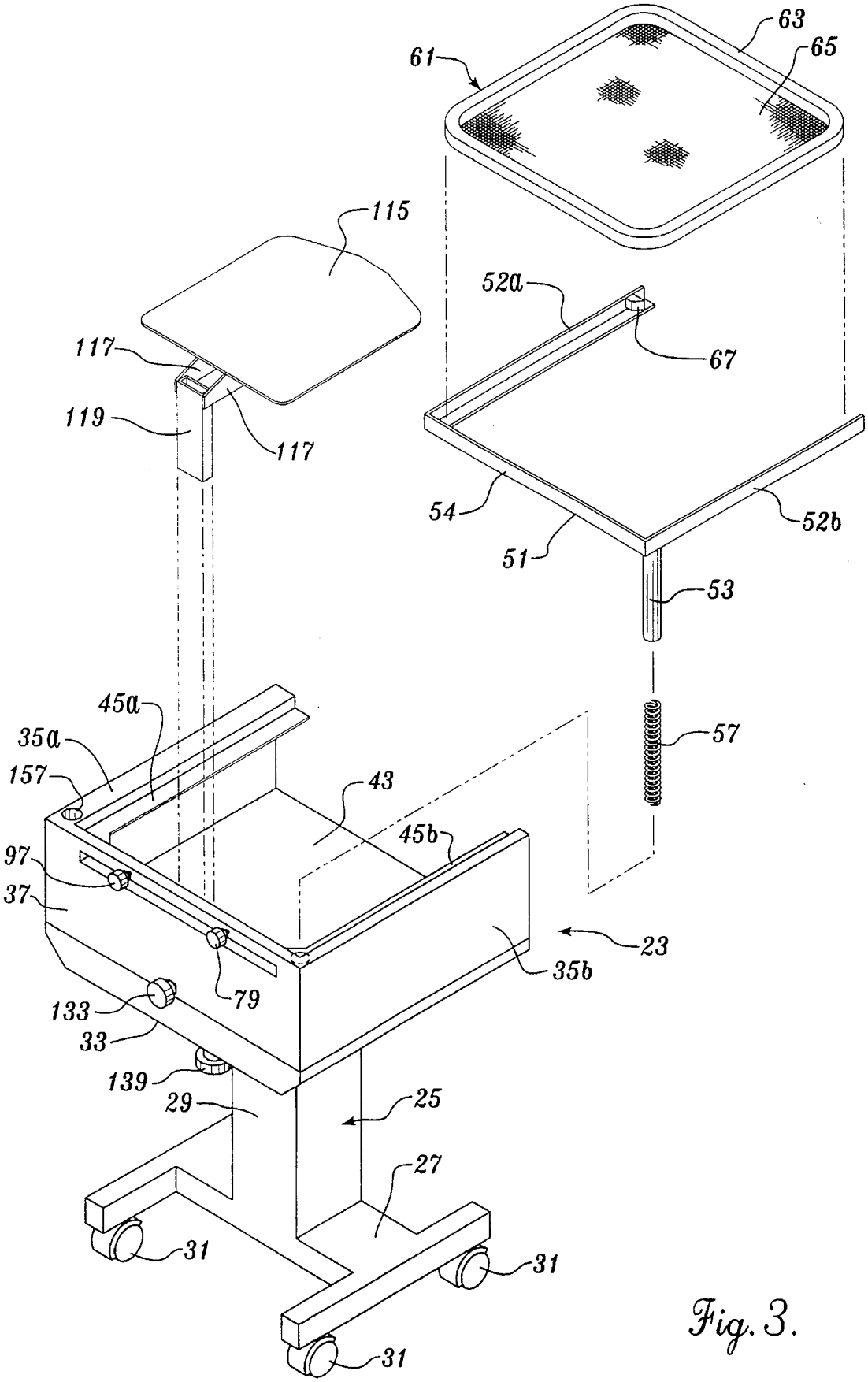
FIG. 3 is a further exploded view of the embodiment of the invention illustrated in FIG. 1.
Figure 4:
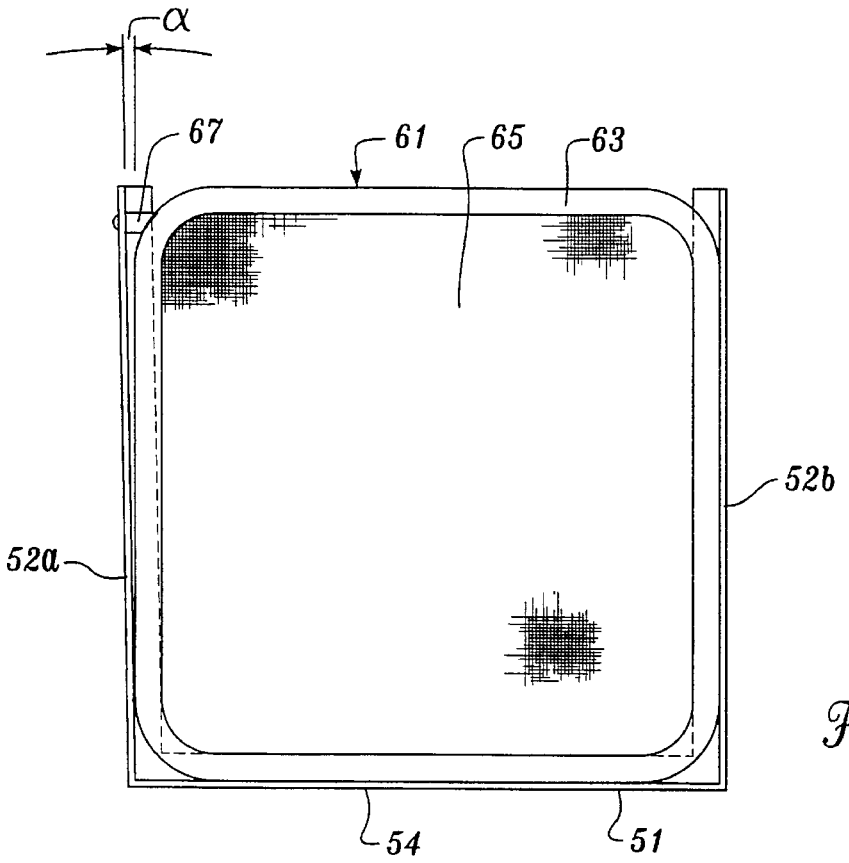
FIG. 4 is a top plan view of the print screen and U-shaped frame shown in FIGS. 1–3.
Figure 5:
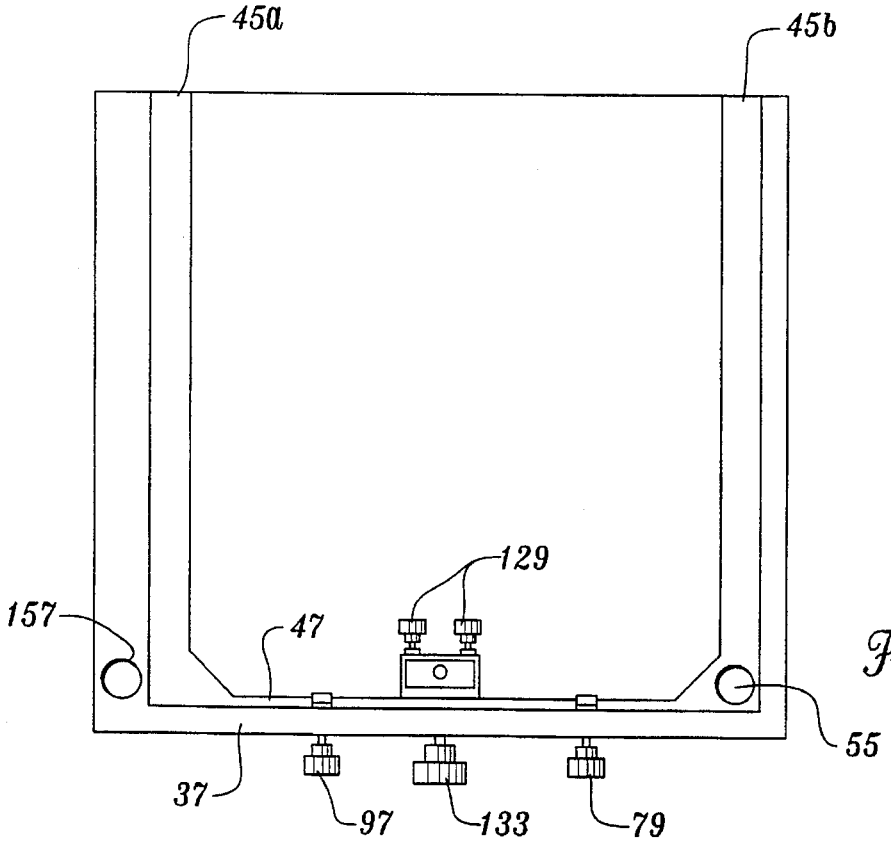
FIG. 5 is a top plan view of the embodiment of the invention shown in FIGS. 1–3 with the U-shaped frame and print screen removed.

As shown best in FIGS. 2, 3, and 5, extending inwardly from each of the side walls 35*a* and 35*b*, near the top thereof, is a narrow shelf 45*a* and 45*b*. An even narrower shelf 47 extends inwardly from the back wall 37 of the cabinet 23. All of the shelves 45*a*, 45*b*, and 47 are coplanar. The side wall shelves 45 support a pop-up screen holder 50 best seen in FIGS. 2, 3, 4 and 6. The pop-up screen holder 50 comprises a U-shaped frame 51 whose outwardly extending arms 52*a* and 52*b* and cross-member 54 have an L-shaped cross-sectional configuration. One leg of the L-shape is vertical and the other is horizontal. The horizontal legs extend inwardly from the arms 52*a* and 52*b* and cross-member 54 and form the bottom of the U-shaped frame 51. The U-shaped frame 51 lies in a horizontal plane.

Affixed to and extending vertically downwardly from one of the corners of the U-shaped frame where the cross-member 54 joins one of the outwardly extending arms 52*b* is a tubular leg 53. The outer diameter of the tubular leg is sized to slidably fit into a suitably sized cylindrical vertical hole 55 (FIG. 5) formed in a corner of the cabinet 23 where one of the side wall narrow shelves 45*b* intersects the back wall narrow shelf 47. Mounted in the cylindrical leg 53 is a coil spring 57. The length of the coil spring 57 is chosen to create an upward force adequate to raise the U-shaped frame 51, above the side walls 35*a* and 35*b*, and the back wall 37, when the coil spring 57 is mounted in the tubular leg 53 and the tubular leg 53 is slidably mounted in the cylindrical hole 55.

As illustrated in FIGS. 1–4 and 6, the U-shaped frame 51 is sized to receive a print screen 61. The illustrated print screen 61 has a square shape and preferably includes a frame 63 formed of a square-shaped metal tube and having rounded corners. The print screen 61 includes a screen 65 having a suitably fine mesh stretched across the bottom of the frame 63. The arms 52*a* and 52*b* of the U-shaped frame 51 are substantially equal in length to the width of the frame 63 of the print screen 61. The length of the cross-member 54 of the U-shaped frame 51 is substantially equal to the width of the print screen frame 63. As a result, the print screen frame is sized to fit inside the U-shaped frame 51, atop the horizontal legs of the arms 52*a* and 52*b* and the cross-member 54.

Located at the outer end of one of the arms 52*a* of the U-shaped frame 51 is a bevel block 67. The bevel block is oriented and positioned so as to apply spring pressure created by the arm 52*a* supporting the bevel block against one of the curved corners of the frame 63 of a print screen 61 mounted in the U-shaped frame 51, pressing the print screen 61 into the opposite corner of the U-shaped frame 51, i.e., the corner where the other arm 52*b* joins the cross-member 54. Preferably, the pressure creates a slight angle $\alpha$ between the vertical leg of the arm 52*a* containing the bevel block 67 and the U-shaped frame 51, as best shown in FIG. 4.

As will be readily appreciated from the foregoing description, the bevel block 67 maintains the frame 63 of the print screen 23 and, thus, the fine mesh 65 in a fixed position with respect to the U-shaped frame. As a result, precisely positioning the U-shaped frame in the manner described below precisely positions a print screen mounted in the U-shaped frame. Print screens are removed from the U-shaped frame by springing the arm 52*a* containing the bevel block 67 outwardly to release the force produced by the bevel block, or by lifting the print screen above the cross-member 54 and pulling the print screen away from the bevel block. Print screens returned to the U-shaped frame are forced into exactly the same position in the U-shaped frame 51 by the force created by the pressure applied to the bevel block 67 by the sprung arm 52*a*.

As noted above, the U-shaped frame 51 is spring loaded upwardly by the coil spring 57. As will be better understood from the following description, when raised, the U-shaped frame 51 and, thus, the print screen 61 can be rotated away from the cabinet 23 to allow a print to be observed, a heater to be moved into position, or the substrate to be removed or replaced. During use, the U-shaped frame 51 is latched down by a latch mechanism 71 illustrated in FIGS. 6, 7, and 8. In the latched position, the arms 52*a* and 52*b* of the U-shaped frame lie atop the small shelves 45*a* and 45*b* that extend inwardly from the side walls 35*a* and 35*b*.

The latch mechanism 71 is mounted in a rectangular-shaped channel 73 integrally formed atop the back wall 37 of the cabinet 23. The latch mechanism 71 includes a horizontally oriented shaft 75 that is slidably mounted in a hole in the back wall of the channel 73. The hole is surrounded by a support collar 77 affixed to the inside of the back wall of the channel 73. Mounted on the outer end of the shaft 75 is knob 79. Threaded onto the inner end of the shaft 75 is a latch element 81. The latch element 81 has a square cross-sectional configuration when viewed in a vertical plane lying parallel to the back wall 37 of the cabinet 23. When viewed in a vertical plane lying orthogonal to the back wall 37, best seen in FIG. 7, the latch element 71 has a downwardly inclined inner end. That is, the end of the latch element 81 facing the cross-member 54 of the U-shaped frame 51 inclines downwardly. The lower end or tip of the incline is aligned with a slot 83 formed in the vertical leg of the cross-member 54 of the U-shaped frame 51. The latch element is positioned in a square hole 84 formed with inner walls of the rectangular-shaped channel 73.

Figure 8:
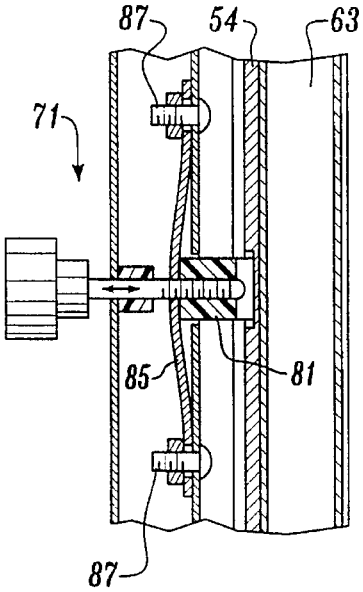
FIG. 8 is a cross-sectional view along line 8—8 of FIG. 7.

The latch mechanism 71 also includes a leaf spring 85, best seen in FIG. 8, affixed to the inner wall of the rectangular-shaped channel 73. More specifically, the leaf spring 85 extends over the rear face of the latch element 81 (i.e., the side of the latch element facing the knob 79). The leaf spring is attached to the inner wall of the rectangular-shaped channel 73, on either side of the latch element 81, by a pair of bolts 87. Thus, the leaf spring 85 creates a three that pushes the latch element 81 toward the cross-member 54 of the U-shaped frame 51. The latch element 81 is withdrawn by pulling the knob 89 against the force produced by the leaf spring 85. This action removes the tip of the latch element 81 from the slot 83 in the cross-member 54 of the U-shaped frame 51, allowing the U-shaped frame 51 (and a print screen, if one is mounted in the U-shaped frame) to pop upwardly due to the force produced by the coil spring 57.

Figure 6:
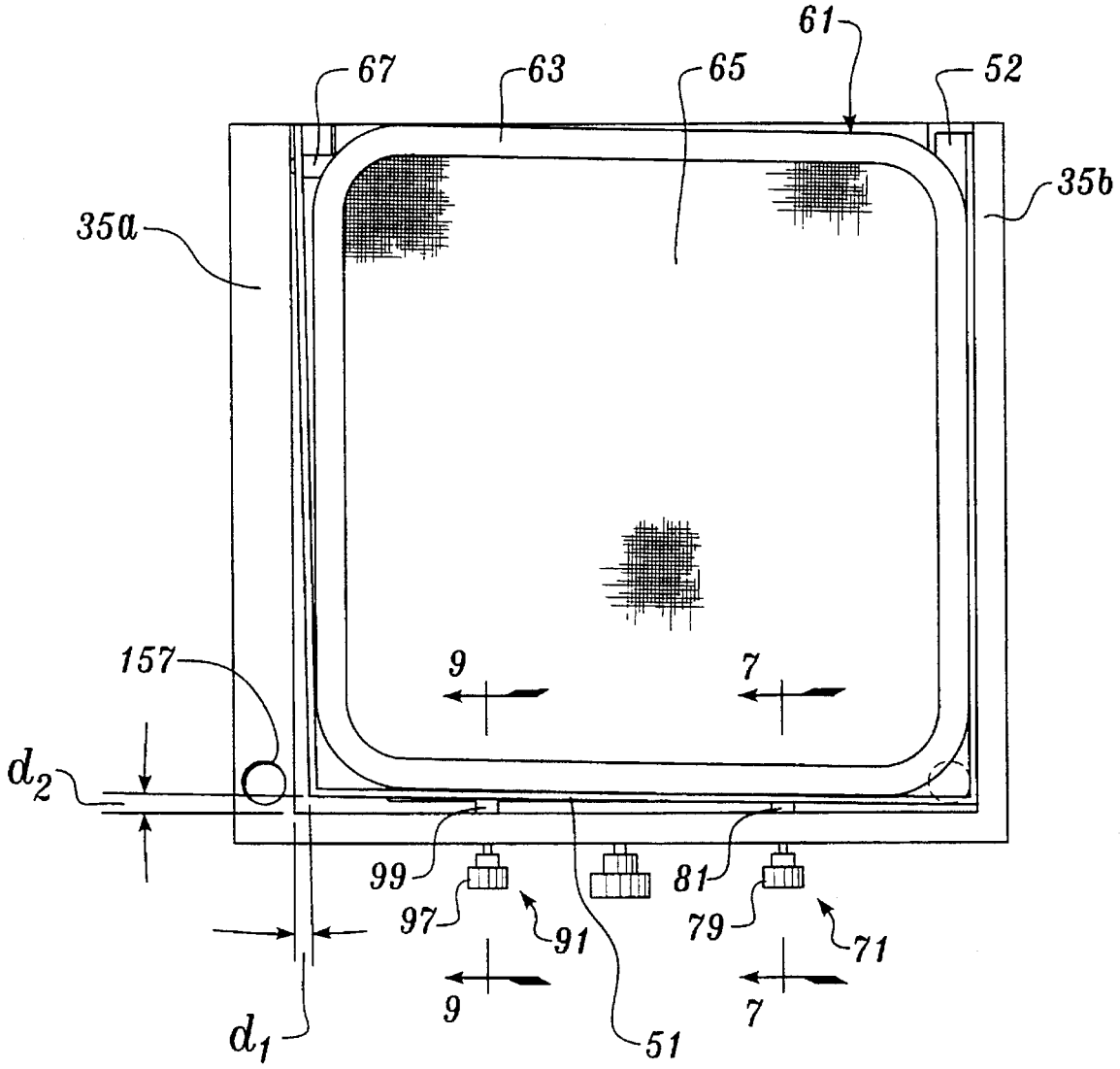
FIG. 6 is a top plan view of the embodiment of the invention illustrated in FIGS. 1–3 with the print screen and U-shaped frame in place.
Figure 7:
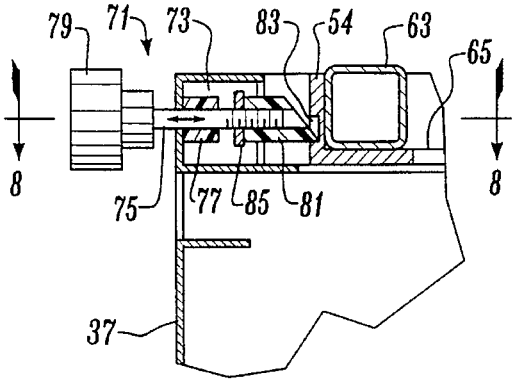
FIG. 7 is a cross-sectional view along line 7—7 of FIG. 6.
Figure 9:
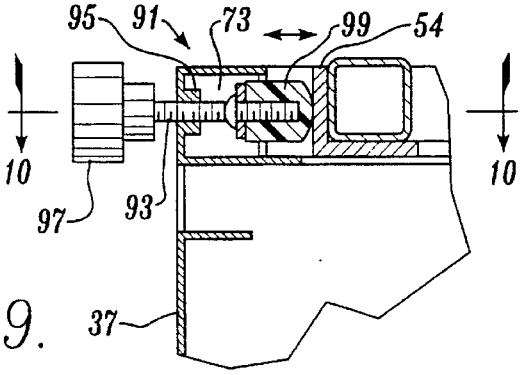
FIG. 9 is a cross-sectional view along line 9—9 of FIG. 6.
Figure 10:
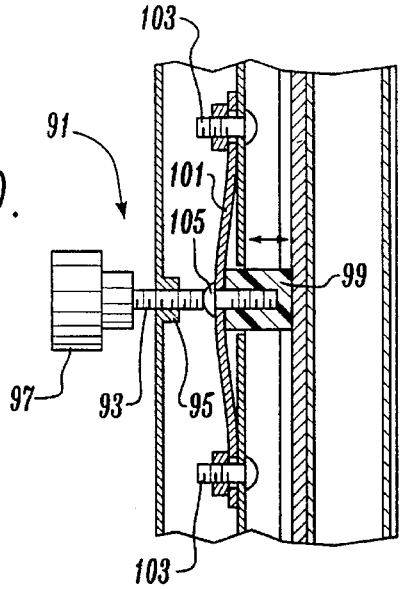
FIG. 10 is a cross-sectional view along line 10—10 of FIG. 9.

The position of the U-shaped frame 51 and, thus, a print screen 61 mounted in the U-shaped frame is controlled by a screen registration mechanism 91, best illustrated in FIGS. 6, 9 and 10. The screen registration mechanism comprises a threaded shaft 93 screwed through a threaded hole surrounded by a boss 95 located in the back wall of the rectangular-shaped channel 73. A knob 97 is mounted on the outer end of the threaded shaft 93.

The screen registration mechanism 91 also includes a registration element 99 and a leaf spring 101. The registration element 99 has a square cross-sectional shape when viewed in a plane lying parallel to the back wall 37 of the cabinet 23. When viewed in a plane lying orthogonal to the back wall 37, the inner end of the registration element 99 is convexly curved and the outer end is flat. The registration element 99 passes through a square hole formed in the inner wall of the rectangular-shaped channel 73. The leaf spring 101 is affixed to the inside of the inner wall of the channel 73 by a pair of bolts 103 located on opposite sides of the hole through which the registration element 99 passes.

A cap screw 105 attaches the registration element 99 to the leaf spring 101. The cap screw 105 is aligned with the inner end of the threaded shaft 93 on which the knob 97 is mounted. As best shown in FIG. 9, the registration element 99 is aligned with the outer face of the vertical wall of the cross-member 54 of the U-shaped frame 51. As a result, when the knob 97 is rotated in the direction that moves the shaft 93 toward the cross-member 54, the registration element 99 moves toward the cross-member. When the knob 97 is rotated in the direction that moves the shaft 93 away from the cross-member 54, the coil spring pulls the registration element 99 away from the cross-member.

As will be readily understood from the foregoing description, when the registration knob 97 is rotated such that the shaft 93 moves inwardly, the U-shaped frame 51 and, thus, the print screen 61 mounted in the U-shaped frame rotates in a clockwise direction (when viewed from above) about the axis of the tubular leg 53. As a result, as shown in FIG. 6, the corner of the U-shaped frame 91 opposite the corner nearest the registration mechanism 91 is pressed toward the adjacent wall **35*b* of the cabinet 23. Normally such rotation will result in gaps $d_1$ and $d_2$ being formed between the corner of the U-shaped frame nearest the registration mechanism 91 and the adjacent side and back walls 35*a* and 37, respectively. Thus, in summary, the bevel element 67 registers the print screen 23 in the U-shaped frame 51 and the registration mechanism 91 registers the U-shaped frame in the cabinet 23**. The U-shaped frame registration mechanism provides a mechanism for positioning an image contained in a print screen held by the U-shaped frame since the print screen is rotated with the U-shaped frame.

As shown in FIGS. 2 and 3 and FIGS. 11A–11C, the screen printing machine 21 also includes a platen assembly 111 and a platen support and registration mechanism 113. The platen assembly 111 includes a platen 115 preferably formed of metal and sized to support a length of textile fabric or an item of clothing such as a T-shirt or sweatshirt formed of a textile fabric. The platen assembly 115 also includes a pair of arms 117 affixed to the bottom of the platen 115 that extend outwardly from one edge of the platen. Affixed to and extending downwardly from the arms 117 is a platen support leg 119. The platen support leg 119 has the general configuration of a right rectangular parallelepiped with a convex surface on the side facing the hereinafter-described adjustment screws 127. The bottom of the platen support leg 119 is closed, as shown in FIGS. 11A–11C.

The platen support and registration mechanism 113 includes a platen support bracket 121 that includes a pair of arms 123 that are affixed to and extend outwardly from the back wall 37 of the cabinet 23. Affixed to the outer ends of the arms 123 is a box-like element 125. The box-like element 125 has a hollow bottom. The top of the box includes inwardly protruding lips that create a slot sized to receive the platen support leg 119. As shown in FIGS. 11A–11C, the width of the slot is less than the distance between the walls of the box-like element 125 that lie parallel to the back wall 37. As a result, the inwardly protruding lips form fulcrums about which the platen support leg 119 can tilt forwardly and backwardly in the manner described below.

Mounted in the wall of the box-like element 125 that lies parallel to the back wall 37 of the cabinet 23 and nearest thereto is a platen inclination mechanism 130. The platen inclination mechanism comprises a screw 13 1 operated by a knob 133. The screw slidably extends through a hole in the back wall 137 and is threaded through a hole formed in the related wall of the box-like element 125. As the knob 133 is rotated, the screw moves inwardly and outwardly causing the platen assembly 111 to rotate about the fulcrums created by the inwardly protruding lips located at the top of the box-like element 125 and described above. See FIG. 11C.

Rotatably mounted in the wall of the box-like element 125 that lies parallel to the back wall 37 of the cabinet 23 and is most remote from the back wall, near the upper end thereof, is a platen lateral adjustment and lock mechanism 126. The platen lateral adjustment and lock mechanism comprises a pair of adjustment screws 127. Knobs 129 mounted on the outer end of the screws are used to move the screws longitudinally through threaded holes formed in the wall of the box-like element 125 as shown in FIG. 5 and FIGS. 11A–11C. As the screws are moved longitudinally inwardly and outwardly by the rotation of the knobs 127, the platen 115 is moved laterally back and forth, i.e., from one side of the cabinet to the other. Thus, the screws laterally adjust and laterally lock the platen in position.

Threaded through the bottom 33 of the cabinet 23, in alignment with the bottom of the leg 119 of the platen assembly 111, is a platen height adjustment mechanism 135. The platen height adjustment mechanism comprises a threaded shaft 137 and a platen height adjustment knob 139. The upper end of the threaded shaft 137 impinges on the bottom of the platen support leg 119. As a result, as the platen height adjustment knob 139 is rotated in one direction or the other, the shaft 137 of the platen assembly 111 moves upwardly and downwardly whereby the platen 115 is raised and lowered.

In summary, the lateral position of the platen 115 is controlled by the platen lateral adjustment and lock knobs 129. The inclination of the platen is controlled by the platen inclination knob 133 and the height of the platen is controlled by the platen height adjustment knob 139.

As shown in FIGS. 1–3 and 11A–11C, located in the back wall 37 beneath the rectangular-shaped channel 73, is a slot 141. As shown in FIG. **11*a*, the slot allows an elongated piece of fabric 143 to be moved from the open front of the cabinet 23, across the platen, out the slot 141 or vice versa. The slot allows a bolt, or other elongated piece of textile fabric, to have designs created at several locations on the fabric in the manner hereinafter described as the fabric is sequentially moved across the platen, through the screen printing machine 21**.

As shown in FIG. 1, a heater 151 is mounted on an arm 153 having a downwardly extending leg 155 positioned to extend into a hole 157 formed in the corner of the cabinet 23, between the back wall 37 and one of the side walls 35. The corner is opposite the corner receiving the tubular leg 53 of the pop-up screen holder 50. As a result, the heater 151 is movable between a position whereat the heater overlies the cabinet 23 and a position away from the cabinet 23. The latter position is illustrated in FIG. 1. Likewise, while not shown in the drawings, the leg 53 of the U-shaped arm 51 allows the print screen 61 to be moved between a position overlying the cabinet 23 and a position away from the cabinet 23, when the latch that locks the U-shaped frame downwardly is released to allow the coil spring 57 to move the U-shaped frame upwardly.

The screen printing machine 23 illustrated in the drawings and described above can be used to: (i) create an image-bearing screen; (ii) use the image-bearing screen to create prints on suitable substrates, such as textile fabrics; and (iii) heat the print to cure the print ink. In general, the procedure is the same as that described in U.S. Pat. No. 5,355,791, more fully referenced above and incorporated herein by reference. Prior to using the screen printing machine to create an image-bearing print screen and, then, use the print screen to create a design on a substrate, such as a garment formed of a textile fabric, artwork must be created. Artwork can be created by simply copying a preexisting image, such as a logo, or by having a commercial artist create an image. In any event, the image is first copied onto a film or paper that passes UV light. This can be accomplished by placing the image on the original surface of a photocopy machine and running a piece of UV-passing translucent paper through the machine. After the image to be printed is created on the UV-passing translucent paper in this relatively inexpensive manner, the paper is positioned in the screen printing machine. More specifically, the heater 151 is rotated away from alignment with the cabinet 23 in the manner heretofore described (or totally removed). Thereafter, a work surface is created by placing a sheet of transparent material, such as glass or transparent plastic, which may form the cover 43 of the cavity 39, on the arms 52*a* and 52*b* and cross-member 54 of the U-shaped frame 51. The image-bearing UV paper is then placed on top of the glass plate in the desired position. Obviously, this sequence of operations can be changed.

Next, a previously prepared print screen 61 is placed in the U-shaped frame 51 atop the work surface (e.g., the glass plate) and the image-bearing UV paper. The screen is prepared by coating the mesh 65 with a water-soluble photographic emulsion. During and after coating with a photographic emulsion, the screen 61 must be maintained in a "safe" room, i.e., a room that does not contain emulsion-exposing (UV) light. After the coated screen is placed atop the work surface, the UV lamps 41 are energized. Energization of the UV lamps exposes and hardens the photographic emulsions in all areas except the areas covered by the image. After exposure, the screen is washed to remove the still soft water-soluble emulsion lying in the area covered/protected by the image. As a result, a print screen in the form of a stencil is created.

After the print screen has been created, it is used to print a design on a suitable substrate. More specifically, after the work (glass) surface and the image-bearing UV paper are removed, the cover 43 is installed over the UV lamps to protect the UV lamps from ink and other debris. Then the U-shaped frame is popped up and the platen is installed. A print screen is placed in the U-shaped frame after the U-shaped frame is moved downwardly and the latch mechanism 71 engaged. If greater frame stability is required, the knob 97 of the screen registration mechanism 91 is rotated to press the U-shaped frame more tightly against wall 35*b*. After the U-shaped frame and print screen are positioned, the platen is moved to a position just beneath the screen 65. The platen is raised and lowered by rotation of the platen height adjustment knob 139. Lateral and inclination positioning of the platen is accomplished by moving the platen lateral and inclination adjustment knobs 129 and 133. The platen assembly is positioned such that the upper surface of the platen 115 lies just below the mesh side of the screen 65. If desired, the platen position may be set before the U-shaped frame and the screen print are positioned above the platen.

After the platen is adjusted, the print screen is moved out of position. This can be accomplished by simply removing the print screen from the U-shaped frame or by releasing the U-shaped frame by pulling the latch knob 79 outwardly, after relieving any pressure created by the screen registration knob 97. If the U-shaped frame is released, it can be rotated such that the print screen is moved out of vertical alignment with the platen.

After the print screen has been moved out of position, the piece of garment or textile fabric to be printed is placed on the platen. Then the print screen is returned to the print position by either being reinstalled in a latched-down U-shaped frame, or by rotating a detached U-shaped frame carrying the print screen to a position above the platen and moving the U-shaped frame and print screen down until the U-shaped frame is latched.

Prior to moving the screen frame 61 into position, or after positioning, ink is applied to the upper or ink side of the mesh 65. After being positioned just out of touch with the garment or textile fabric supported by the platen, a squeegee is moved across the screen 65 forcing ink through the image apertures defined by the stencil image. As a result, an image is printed on the garment 63 or other substrate mounted on the platen.

After the design is printed, the screen print is removed from the U-shaped frame, or the registration knob pressure is released and the print screen raised by pulling the latch knob 79 outwardly. In the latter case, the print screen is rotated to a position out of alignment with the cabinet 23. In either case the image is viewed to determine if it is complete. If the image is not complete, the print screen is returned to the print position. Thereafter, more ink is applied.

After the design is printed, if necessary, the ink is heated to cure. If multiple colors are to be overlaid to create a multi-color design, each ink can be heated a sufficient amount to make a gel after it is applied, if desired. After all inks are applied, they are heated to a curing temperature. Heating is accomplished by moving the heater 151 to a position where the heater 151 overlies the cabinet 23. The heater 151 is pre-energized so that it is at a suitable temperature when moved into position. The temperature, of course, depends upon the nature of the ink. Plastisol inks require heating to a temperature of approximately 320° to cause cross-linking to occur. Some inks cure at a lower temperature. In fact, some inks even air dry. Heating, of course, increases drying speed and, thus, decreases drying time, regardless of the nature of the ink. After curing, the heater 151 is rotated to the side and the printed item is removed.

In summary, a screen printing machine formed in accordance with this invention is, in essence, an all-in-one machine that can be configured to carry out the three major steps of screen printing-creating an image-bearing print screen, using the screen to print a design on a garment, and curing the ink used to print the design. Multi-colored images can be easily created by simultaneously overlaying the print receiving surface, i.e., the garment or other substrate, with different previously created image-bearing screens. In between printing, preferably, but not necessarily, previous images are partially cured, i.e., gelled to prevent colors from mixing.

The screen registration mechanism holds the U-shaped frame in place to further assure that the print screen will not move. If the print is incomplete, the registration mechanism allows the screen to be precisely returned to the prior position and additional ink applied to complete the image.

As noted above, metal is the preferred material for creating the screen frame 63. Alternatively, wood or a suitably rigid plastic can be utilized. Regardless of how the frame is formed, the lower side of the frame is covered with the screen mesh 65 that is coated with the photographic emulsion. When placed in the U-shaped frame, the print side, i.e., the lower side of the mesh, faces the substrate on which the image is to be created. The other side, i.e., the squeegee or ink side, faces upwardly. Screens can be reused by using a suitable material, such as an emulsion remover, to soften hardened emulsions and, then, washing the mesh to remove the emulsions. After pressure washing, the mesh should be scrubbed with a suitable degreaser before a print screen is reused. Usually, the invention is used in an off-contact printing manner, rather than an on-contact printing manner, i.e., the print side of the mesh is not in physical contact with the print receiving substrate except when it is pressed downwardly by a squeegee. Usually, the space between the print-receiving surface and the mesh is approximately 1/16–1/8 inch.

Preferably the housing of the screen printing machine is formed of metal. As a result, it can readily withstand the high temperatures that occur during the curing of many screen printed designs.

Obviously, the platen can take on shapes different from that shown in the drawings. See for example, the platens shown in FIGS. 3A–3C of U.S. Pat. No. 5,355,791.

The inclusion of a variety of adjustments for the platen, and the registration mechanism for the U-shaped frame, create a precise print screen registration mechanism that allows precise, artistically gratifying designs to be made.

While the presently preferred embodiment of the invention has been illustrated and described, it is to be understood that, within the scope of the appended claims, the invention can be practiced otherwise than as specifically described herein. For example, the pop-up mechanism for the U-shaped frame can be deleted, if desired.

The embodiments of the invention in which an exclusive property or privilege is claimed are defined as follows:

1. A screen printing machine for printing designs on suitable substrates, said screen printing machine comprising:

(a) an open top and open front cabinet that includes a bottom, a pair of side walls, and a back wall;

(b) a print screen comprising a frame and a layer of mesh affixed to the frame;

(c) a print screen receiving frame sized to receive said print screen and including a mechanism for forcing said print screen into a registration position in said print screen receiving frame;

(d) a rotational coupling for rotatably coupling said print screen receiving frame to said cabinet such that said print screen receiving frame and, thus, said print screen, lies in a horizontal plane;

(e) a screen registration mechanism for precisely positioning said print screen receiving frame in said cabinet near the upper edge of said pair of side walls;

(f) a platen for supporting a substrate suitable for receiving a screen print;

(g) a platen support and registration mechanism mounted in said cabinet for supporting and positioning said platen in said cabinet below said print screen receiving frame and, thus, below said print screen; and (h) a heater mounted in said cabinet positionable to heat a substrate supported by said platen.

2. A screen printing machine as claimed in claim 1, including a support mounted in said cabinet and affixed to said side walls for supporting said print screen receiving frame.

3. A screen printing machine as claimed in claim 2 wherein said rotational coupling for rotatably coupling said print screen receiving frame to said cabinet comprises a leg extending downwardly from one corner of said print screen receiving frame and a hole in said cabinet for receiving said leg.

4. A screen printing machine as claimed in claim 3, including a coil spring mounted in said leg for applying upward pressure to said print screen receiving frame adequate to raise said print screen receiving frame and a print screen above the upper edge of said pair of side walls.

5. A screen printing machine as claimed in claim 4, including a latch mechanism for latching said print screen receiving frame in a position atop said support, against the force created by said coil spring.

6. A screen printing machine as claimed in claim 5 wherein said platen support and registration mechanism includes a platen inclination mechanism for controlling the inclination of said platen.

7. A screen printing machine as claimed in claim 6 wherein said platen support and registration mechanism includes a platen lateral adjustment mechanism for controlling the lateral position of said platen.

8. A screen printing machine as claimed in claim 7 wherein said platen support and registration mechanism includes a platen height adjustment mechanism for controlling the height of said platen.

9. A screen printing machine as claimed in claim 8 wherein said print screen frame is U-shaped.

10. A screen printing machine as claimed in claim 9 including an ultraviolet source mounted on the bottom of said cabinet.

11. A screen printing machine as claimed in claim 1 wherein said rotational coupling for rotatably coupling said print screen receiving frame to said cabinet comprises a leg extending downwardly from one corner of said print screen receiving frame and a hole in said cabinet for receiving said leg.

12. A screen printing machine as claimed in claim 11, including a coil spring mounted in said leg for applying upward pressure to said print screen receiving frame adequate to raise said print screen receiving frame and a print screen above the upper edge of said pair of side walls.

13. A screen printing machine as claimed in claim 12, including a latch mechanism for latching said print screen receiving frame in a down position adjacent the top of said side walls, against the force created by said coil spring.

14. A screen printing machine as claimed in claim 1 wherein said platen support and registration mechanism includes a platen inclination mechanism for controlling the inclination of said platen.

15. A screen printing machine as claimed in claim 14 wherein said platen support and registration mechanism includes a platen lateral adjustment and lock mechanism for laterally adjusting and locking the platen in position.

16. A screen printing machine as claimed in claim 15 wherein said platen support and registration mechanism includes a platen height adjustment mechanism for controlling the height of said platen.

17. A screen printing machine as claimed in claim 1 wherein said platen support and registration mechanism includes a platen lateral adjustment and lock mechanism for laterally adjusting and locking the platen in position.

18. A screen printing machine as claimed in claim 17 wherein said platen support and registration mechanism includes a platen height adjustment mechanism for controlling the height of said platen.

19. A screen printing machine as claimed in claim 1 wherein said platen support and registration mechanism includes a platen height adjustment mechanism for controlling the height of said platen.

20. A screen printing machine as claimed in claim 1 wherein said print screen frame is U-shaped.

21. A screen printing machine as claimed in claim 1 including an ultraviolet source mounted on the bottom of said cabinet.

* * * * *